US005358400A

United States Patent [19]

Ejiri et al.

[11] Patent Number: 5,358,400

[45] Date of Patent: Oct. 25, 1994

[54] PLUG MOUNT STRUCTURE OF A PULSE COMBUSTION APPARATUS

[76] Inventors: Susumu Ejiri; Makoto Kimura, both of Momozono No. 6-23 Mizuho-ku, Nagoya, Japan

[21] Appl. No.: 203,851

[22] Filed: Feb. 28, 1994

Related U.S. Application Data

[63] Continuation of Ser. No. 973,345, Nov. 9, 1992, abandoned.

[30] Foreign Application Priority Data

Nov. 13, 1991 [JP] Japan ..... 3-101811[U]

[51] Int. Cl.[5] ..... F23C 11/04

[52] U.S. Cl. ..... 431/1; 431/258; 431/2; 123/169 EC

[56] References Cited

U.S. PATENT DOCUMENTS

| | | | |
|---|---|---|---|
| 1,264,548 | 4/1918 | Nicolaysen | 123/169 R X |
| 1,322,493 | 11/1919 | Little | 123/169 R X |
| 1,468,539 | 9/1923 | McCune et al. | 123/169 R X |
| 1,501,531 | 7/1924 | Earnshaw | 123/169 C |
| 1,564,950 | 12/1925 | Curran | 123/169 C |
| 2,129,472 | 9/1938 | Lysholm et al. | 431/264 X |
| 2,870,760 | 1/1959 | Michaud | 123/169 R |
| 2,899,479 | 8/1959 | Atwell et al. | 123/169 R |
| 2,921,109 | 6/1960 | Novak | 123/169 R |
| 3,409,939 | 10/1968 | Saha | 431/263 |
| 3,689,195 | 9/1972 | Beesch et al. | 431/208 |
| 3,999,935 | 12/1976 | Stabinsky et al. | 431/158 X |
| 4,480,985 | 11/1984 | Davis | 431/1 |
| 4,642,046 | 2/1987 | Saito et al. | 431/1 X |
| 5,020,987 | 6/1991 | Ishigino et al. | 431/1 |

FOREIGN PATENT DOCUMENTS

| | | | |
|---|---|---|---|
| 536932 | 10/1931 | Fed. Rep. of Germany | 123/169 R |
| 1246152 | 8/1967 | Fed. Rep. of Germany | 431/1 |
| 0075970 | 6/1981 | Japan | 123/169 CL |
| 0002805 | 1/1985 | Japan | 431/1 |

*Primary Examiner*—Carl D. Price
*Attorney, Agent, or Firm*—Jordan and Hamburg

[57] ABSTRACT

In order to obtain good efficiency of a pulse combustion apparatus, an ignition plug is protected to extend its life span by way of controlling the rotation of the ground electrode at the wall face of a combustion chamber wherein 100° ~ 200° C. may be reduced from a conventional temperature of 900° C. at the ground electrode in the ignition plug.

7 Claims, 4 Drawing Sheets

PLUG MOUNT STRUCTURE OF A PULSE COMBUSTION APPARATUS

This application is a continuation of application Ser. No. 07/973,345 filed Nov. 9, 1992 abandoned.

BACKGROUND OF THE INVENTION

1. Field of the Invention

This invention relates to a pulse combustion apparatus in which pulsating explosive combustions occur repeatedly and continuously. A pulse combustion apparatus performs repeatedly explosive combustions in a certain cycle by making use of self-ignition and natural suction of air for combustion at the time of regular combustion, and wherein combustion heat is used for cooking devices and etc.

2. Description of the Prior Art

One example of a combustion chamber of this pulse combustion apparatus is shown in FIG. 4. A combustion chamber 1 in which explosive combustions are carried on is generally formed and sectioned by a wall 3 having a curved face similar to that of a snail with a fundamental curvature owing to the characterization of combustion and so on. An ignition plug 10 is set and inserted into the curved wall 3 spirally by the screw part 13. Also, 7 in the Figure represents a tail pipe for the discharge of combustion exhaust.

SUMMARY OF THE INVENTION

As the temperature inside the combustion chamber 1 of such pulse combustion apparatus becomes, however, very high, the edge (L letter-shape part shown by the broken line) of the ground electrode 12 on the ignition plug 10 often has been burnt and damaged as shown in FIG. 4. For this reason, the life span of the ignition plug 10 becomes short.

From this point, the present inventors thought it is possible to protect the ground electrode 12 if the same ground electrode 12 would be positioned near the combustion chamber wall 3, when a test result suggested a fact that temperature distribution inside the combustion chamber 1 becomes lower towards the wall 3 of the combustion chamber.

An object of the present invention is to provide a pulse combustion apparatus in which the above problem may be resolved to extend the life span of the ignition plug by a new plug mount structure for reducing heating of the ground electrode according to the above idea.

This invention is summarized as that of an ignition plug mount structure of a pulse combustion apparatus, a combustion chamber wall of which is screwed into an ignition plug whose sparks start pulsating explosive combustions, which is characterized in that a ground electrode which is positioned at the side of the top of an ignition plug is set near an inner wall face of the combustion chamber by using a spacer, which decides the inserting position of the ignition plug with the selected thickness.

According to the above mount structure of the ignition plug in the pulse combustion apparatus subject to this invention, the ground electrode may be positioned at a point near the inner wall of a combustion chamber by way of selecting the thickness of a spacer. That is, a prior art position of ignition plus is at a random point, because there is uncertainty in a screw-cut part of the ignition plug, the plug inserting hole in a combustion chamber and the like, or tightening torque or so on.

When a spacer is selectively used, the ground electrode may be set near the inner wall face of a combustion chamber. Therefore, temperature distribution becomes lower towards the wall of the combustion chamber, and temperature of the ground electrode becomes low so that heat collapse and undesirable effects may be lightened.

In order to clarify further the composition and function of this invention explained in the above, a suitable practical example for the ignition plug mount structure of the pulse combustion apparatus is explained as below according to this invention.

DETAILED DESCRIPTION OF THE PREFERRED EMBODIMENT

Figure 1:
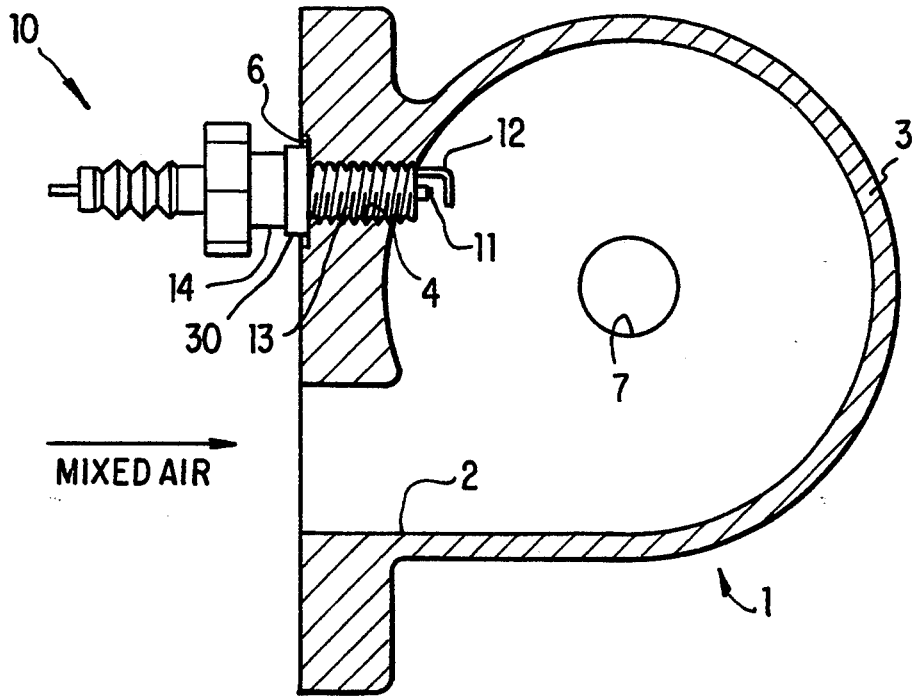
FIG. 1 is a schematic cross-sectional front-view of a combustion chamber used in a pulse combustion apparatus as a practical example.

In FIG. 1, the combustion chamber 1 is a chamber where mixed air supplied from a mixing chamber not shown in the Figure is drawn in and at a certain cycle and explosive combustions are repeated, and this chamber is formed with a snail shape possessing a cave of almost circular cross section with a fundamental curvature in this practical example. The entrance 2 of the combustion chamber connected with the mixing chamber not shown in the Figure, is formed towards a tangent of the combustion chamber 1 in order to take in mixed air well and also to prevent backfire.

In the wall 3 composing this combustion chamber 1, a screw hole 4 for installing an ignition plug (hereinafter called a plug fitting hole 4) and a screw hole 5 for fixing a flame rod are provided therewith, and an ignition plug 10 and a flame rod 20 are respectively set and inserted into holes by screwing.

The ignition plug 10 has a central electrode 11 provided at the center of the top, a ground electrode 12 bent in the form of the letter L provided at the side of the central electrode, a cylindrical screw part 13 provided on the central side thereof and a stopper 14 in a ring shape with diameter larger than that of the screw part 13 provided at the end of the same screw part 13, according to a general firing device. In the conventional device, the ignition plug 10 had the screw part 13 instantly screwed into the plug fitting hole 4 formed in the combustion chamber 1. Screwing was done with use of the necessary torque until the stopper 14 is stopped and engaged with a peripheral outer-wall of the combustion chamber surrounding the plug fitting hole 4 (hereinafter called a contact face 6). Compared to this, a spacer 30 in a ring form in inserted on the screw part 13, according to this invention. Consequently, there is a state in which the spacer 30 was set between the stopper 14 and the contact face 6 of the combustion chamber 1 when the plug was screwed therein.

4 sizes in thickness of the spacer 30 can be used for this example, which are respectively different by $\frac{1}{4}$ pitch in respect with the pitch of the screw part 13. In series, the spacer 30 has H, H+P/4, H+P/2, and H+3P/4, when the thickness of the thinnest space 30 is H and P is the length of one pitch. Accordingly, the ignition plug 10 can be stopped and positioned with ¼ pitch difference subject to the thickness of the spacer 30.

Figure 2A:
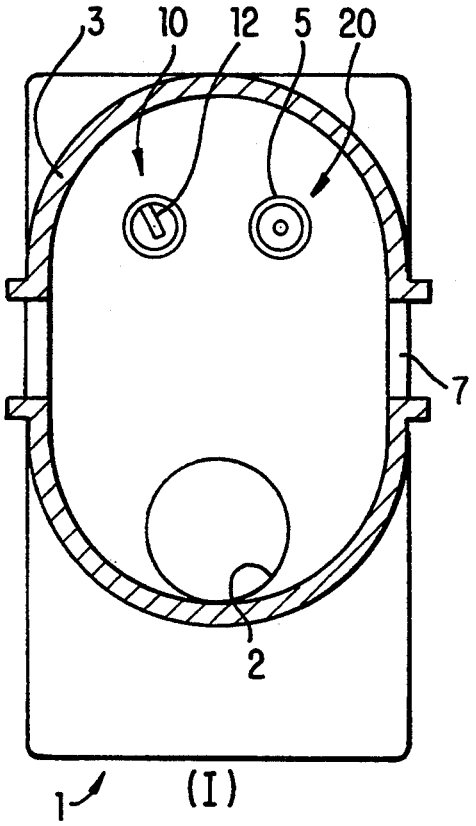
FIG. 2 is a schematic cross-sectional side-view of this example.
Figure 2B:
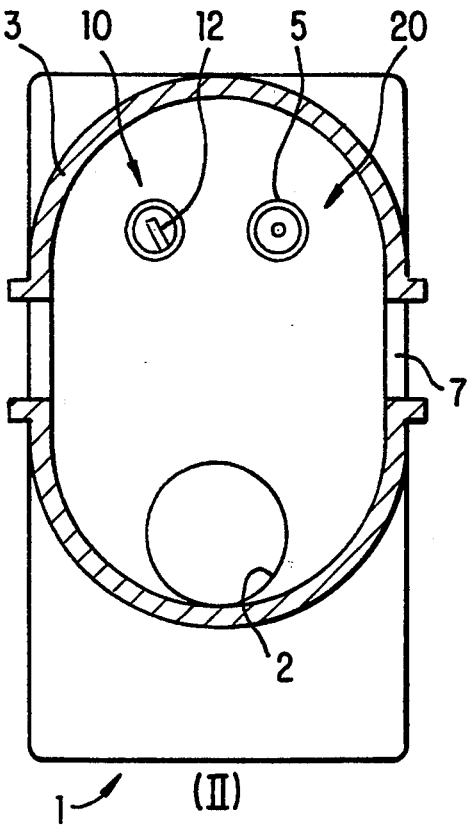
Figure 3:
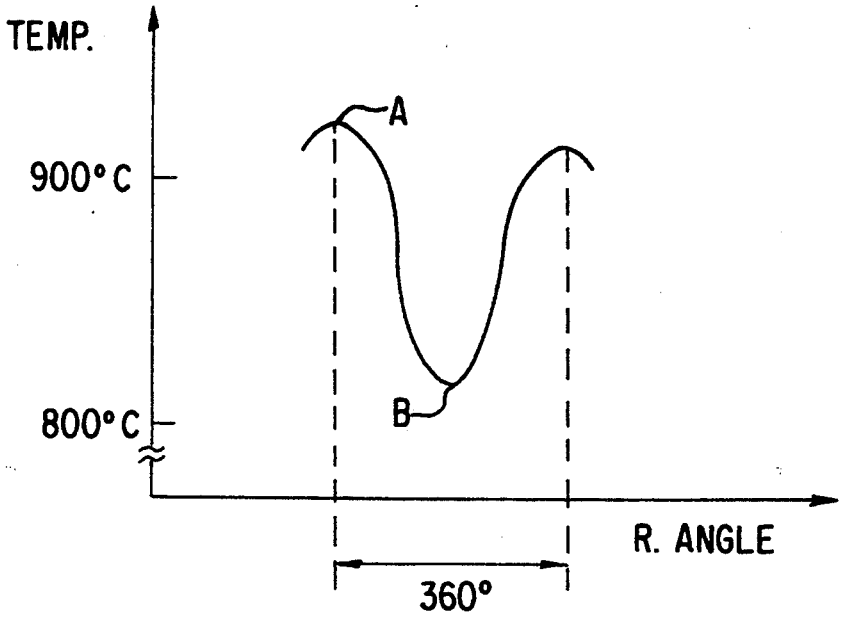
FIG. 3 is a graph of temperature characteristics at the ground electrode.
Figure 4:
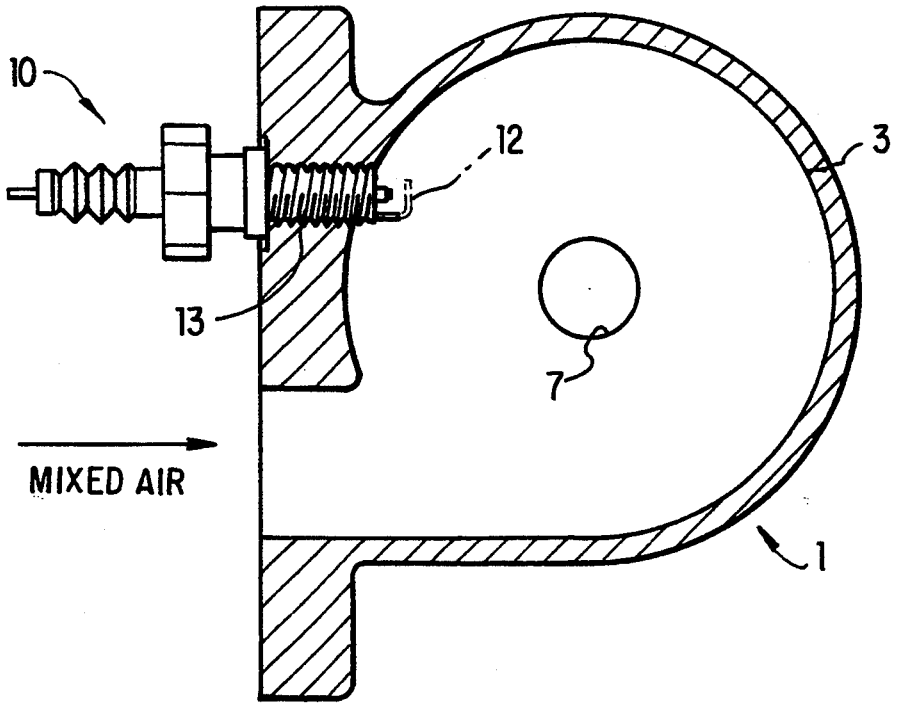
FIG. 4 is a schematic cross-sectional front-view of the combustion chamber in the pulse combustion apparatus of a prior art.

FIG. 3 now suggests the relation between temperature and position of the ground electrode 12. Data in FIG. 3 are obtained by experiment, which presents rotating the angle of the inserted ignition plug 10 in the horizontal axis and temperature of the ground electrode 12 in the vertical axis. From the Figure, the temperature of the ground electrode 12 changes about 100° C. in response to the rotating angle, that is, the position of the inserted ignition plug 10. By this data, as the ground electrode 12 becomes nearer the center of combustion chamber 1 (point A in FIG. 3), the temperature becomes higher. In contrast, the nearer the inner wall face of combustion chamber 1 (point B in FIG. 3), the lower the temperature of ground electrode 12. In other words, when the position of the ground electrode 12 is nearest to the inner face of wall 3 in the combustion chamber 1 as shown (I) in FIG. 2, the temperature becomes lower by about 100° C. than when the ground electrode 12 faces the center of combustion chamber 1 as shown (II) in FIG. 2.

From the above, the practical example uses to set one of the spacers (4 sizes) by which the ground electrode 12 is positioned nearest to the inner wall face of the combustion chamber 1. The ground electrode 12 can be set to face the inner wall face of the combustion chamber 1, in spite of the precision with which the ignition plug 10 and the plug fitting hole 14 of the combustion chamber 1 are respectively screw-cut.

Therefore, the temperature of the ground electrode is always controlled at low, so that the life span of the ignition plug 10 may be extended with effect of lightening heat collapse of the ground electrode 12 subject to combustion heat. The temperature can be reduced to 750° C. further to 700° C. by controlling the direction of the ground electrode 12 towards the wall face of combustion chamber 1, while the temperature reached 900° C. at the ground electrode in the prior art.

This invention explained as the above practical example is not limited by such practical example and of course can be practiced within the limits by not deviating from the major points thereof. For example, although a spacer 30 is of 4 sizes having different thicknesses by ¼ pitch , the number of the size may be increased so that the ground electrode 12 will be further more near the inner wall face, or otherwise reduced to be simplified.

From the above, the temperature can be lowered at the ground electrode of an ignition plug according to the ignition plug mount structure, and the life span of the ignition plug can be extended by lightening heat collapse of the ground electrode.

What is claimed is:

1. A plug mount structure for installing an ignition plug into a pulse combustion apparatus, the combustion apparatus having a combustion chamber with an inner wall having a curved inner surface and a threaded hole which extends through the inner wall, and the ignition plug having a ground electrode at a top end thereof and a threaded securing part, said threaded securing part being adapted to be threadedly received in the threaded hole to secure the ignition plug to the combustion apparatus such that the ground electrode is positioned in the combustion chamber, the threaded securing part having a distal edge extending into the chamber and the inner surface having a curvature such that positions on the distal edge closer to a center of the chamber are positioned further away from the inner surface than positions on the distal edge further from the center of the chamber, the plug mount structure comprising:

a stopper portion fixed on said ignition plug; and spacer means for controlling an initial threaded position of said ignition plug in said threaded hole such that said ground electrode is at a desired rotational orientation in, and close to the inner surface of the inner wall of, the combustion chamber so as to reduce the temperature at the ground electrode, said spacer means including a spacer washer of a selected thickness in surrounding relation to said ignition plug and positioned between an in contact with said stopper portion and said combustion apparatus when said ignition plug is threaded into said threaded hole such that the thickness of the spacer washer determines the rotational orientation of the ground electrode in the combustion chamber to the desired rotational orientation and provides that the ground electrode is positioned close to the inner surface of the inner wall of the combustion chamber so as to reduce the temperature of the ground electrode in the combustion chamber.

2. A plug mount structure according to claim 1, wherein said spacer means includes a plurality of spacer washers having different predetermined spacing thicknesses in dependence on said desired rotational orientation, with only one of said spacer washers being provided in said surrounding relation, in dependence on said desired rotational orientation.

3. A method of installing an ignition plug into a pulse combustion apparatus, the combustion apparatus having a combustion chamber with an inner wall having a curved inner surface and a threaded hole which extends through the inner wall, and the ignition plug having a ground electrode at a top end thereof, a stopper portion and a threaded securing part between said ground electrode and said stopper portion, said threaded securing part being adapted to be threadedly received in the threaded hole to secure the ignition plug to the combustion apparatus such that the ground electrode is positioned in the combustion chamber, the threaded securing part having a distal edge extending into the chamber and the inner surface having a curvature such that positions on the distal edge closer to a center of the chamber are positioned further away from the inner surface than positions on the distal edge further from the center of the chamber, the method comprising the steps of:

determining a desired rotational orientation of the ground electrode in the combustion chamber;

selecting a spacer of a predetermined spacer thickness from a plurality of spacers having different predetermined spacer thicknesses, in dependence on said desired rotational orientation such that the thickness of the spacer determines the rotational orientation of the ground electrode in the combustion chamber to the desired rotational orientation and provides that the ground electrode is positioned close to the inner surface of the inner wall of the combustion chamber so as to reduce the temperature of the ground electrode in the combustion chamber;

positioning the selected spacer between said stopper portion and said combustion chamber; and threadedly securing said ignition plug into said threaded hole with the selected spacer being positioned between and in contact with said stopper portion and said combustion chamber, such that said ground electrode is at said desired rotational orientation in, and close to the inner surface of the inner wall of, the combustion chamber so as to reduce the temperature at the ground electrode.

4. A method according to claim 3, wherein each of said plurality of spacers is formed by a spacer washer which slidably fits around said ignition plug.

5. A method according to claim 3, wherein said ground electrode is L-shaped, and said desired rotational orientation is a position at which the ground electrode is nearest to the inner surface of the inner wall of the combustion chamber and points in a direction toward a center of said combustion chamber.

6. A method according to claim 3, wherein said step of determining includes the step of determining an initial threaded position of said ignition plug in said threaded hole in order to achieve said desired rotational orientation of said ground electrode, and said step of selecting includes the step of selecting one of said spacers so that threading of said ignition plug in said threaded hole is started at said initial threaded position.

7. A method according to claim 3, wherein said ignition plug has a central longitudinal axis, and said ground electrode has an axial leg positioned in substantially parallel, spaced relation to said central longitudinal axis and a transverse leg connected with a free end of said axial leg and extending substantially transverse to said central longitudinal axis.

* * * * *